United States Patent [19]

Collins

[11] Patent Number: 4,947,415

[45] Date of Patent: Aug. 7, 1990

[54] FLASH X-RAY APPARATUS

[75] Inventor: Carl B. Collins, Richardson, Tex.

[73] Assignee: Board of Regents, The University of Texas System, Austin, Tex.

[21] Appl. No.: 861,491

[22] Filed: May 9, 1986

[51] Int. Cl.[5] ..... H01J 35/22

[52] U.S. Cl. ..... 378/122; 378/106; 378/140

[58] Field of Search ..... 378/101–102, 378/105–107, 121–123, 140; 313/361.1, 363.1; 328/67, 233, 235

[56] References Cited

U.S. PATENT DOCUMENTS

| | | | |
|---|---|---|---|
| 2,341,483 | 2/1944 | Stephen | 378/123 |
| 2,900,542 | 8/1959 | McEuen | 378/156 |
| 3,783,288 | 1/1974 | Barbour et al. | 378/122 |
| 4,039,971 | 8/1977 | Wang et al. | 372/84 |
| 4,077,020 | 2/1978 | Anderson et al. | 372/84 |
| 4,223,279 | 9/1980 | Bradford, Jr. et al. | 372/86 |
| 4,423,510 | 12/1983 | Pack et al. | 372/82 |
| 4,429,228 | 1/1984 | Anderson | 250/374 |
| 4,498,183 | 2/1985 | Levatter | 372/86 |
| 4,556,981 | 12/1985 | Cirkel et al. | 372/86 |
| 4,563,584 | 1/1986 | Hoffman et al. | 250/366 |
| 4,570,106 | 2/1986 | Sohval et al. | 313/363.1 |

FOREIGN PATENT DOCUMENTS

| | | | |
|---|---|---|---|
| 0819850 | 4/1981 | U.S.S.R. | 378/122 |
| 0589127 | 7/1947 | United Kingdom . | |

OTHER PUBLICATIONS

"The Physics of Electricity and Magnetism", by Scott, 2nd Edition, John Wiley & Sons, 1966, p. 228.

"Flash X-Ray Tube . . . ", by Johnson et al., Rev. Sci. Instrum. 51(6), Jun. 1980, p. 741.

"A High Intensity, Fine Focus . . . ", by Ottewell et al., J. Phys. E. (G.B.), vol. 4, No. 10 (Oct. 1977).

"A High Energy Flash X-Ray Facility", by Gilbert et al., British Journal of NDT, May 1974.

"Off-Resonance Transformer Charging for 250 KV Water Blumlein", by Cook et al., IEEE Trans. on electron devices, vol. ED-26, No. 10, 10-1979.

"Flash X-Ray Actuated Trigger Switch", by Swift et al., Rev. of Scientific Instruments, vol. 39, No. 5, 5-1968.

*Primary Examiner*—Janice A. Howell

*Assistant Examiner*—John C. Freeman

*Attorney, Agent, or Firm*—Arnold, White & Durkee

[57] ABSTRACT

An apparatus for producing high energy, pulsed, flash X-rays which is of a useful laboratory-scale size. The apparatus includes a hydrogen thyratron coupled between a D.C. power source and a low impedance Blumlein, and a low impedance X-ray head. The thyratron is in a grounded grid configuration and provides a commutated input voltage to the Blumlein at a high repetition rate. The switching waveform output of the Blumlein is applied across a pair of spaced electrodes in the X-ray head to produce an X-ray emitting discharge therebetween. A portion of the electrode assembly is preferably cast integral in an insulating base plate of the head. A pair of foil sheet conductors are preferably cast in the base plate to respectively connect the electrodes to the Blumlein. An apertured cover plate is mounted over the base plate with a seal ring interposed between the plates around the electrodes to establish a sealable evacuatable chamber around the discharge gap between the electrodes.

35 Claims, 3 Drawing Sheets

FLASH X-RAY APPARATUS

BACKGROUND OF THE INVENTION

This Government may own certain rights to this invention under Office of Naval Research Grant No. N0014-81-K-0653 and N0014-81-K-0478, entitled "Demonstration of Feasibility of Tuning and Stimulation of Nuclear Radiation".

1. FIELD OF THE INVENTION

The present invention relates to an apparatus and method for producing high energy, repetitively pulsed, flash X-rays from a filamentary source. Advantageously, the apparatus is of a laboratory scale size and incorporates a low impedance Blumlein coupled to a low impedance X-ray head.

2. DESCRIPTION OF RELATED ART

Sources of X-ray energies are known, such as the low energy X-ray devices used in the medical arts. However, the present invention relates to a high energy, short pulse, X-ray producing apparatus which is useful in many applications, particularly fundamental physics research where it is desired to produce a high energy light source in the X-ray bandwidth. In the past, such high energy X-rays have been produced by either a laser plasma or synchrotron radiation device. Synchrotrons and laser plasma devices have several advantages, such as rich line spectra and collimated beams; however, they are not only quite expensive to obtain and operate, but additionally are massive devices which are unsuitable in many applications where a compact source of high energy X-rays are desired. In particular, where the distinct advantages of a synchrotron or laser plasma device are not necessary, a compact, laboratory-scale size device which would produce repetitively pulsed, high energy X-rays would be desirable.

Several devices have been proposed for producing such high energy X-rays from a compact, X-ray device. In one instance, a portable X-ray generator has been proposed which is capable of producing repetitively pulsed X-rays having a pulse duration as short as 100 nsec. However, it has been proposed that such a portable generator is limited by fundamental theoretical considerations in producing an X-ray pulse much shorter than 100 nsec.

It is a goal in quantum electronics to develop a compact high energy light source. Theoretically, such a light source within the band widths of general interest would have pulse durations of a few nanoseconds. Therefore, it would be a significant advance in the art if a compact, repetitively pulsed, flash X-ray device were developed which could operate at a pulse duration as short as a few nanoseconds to produce high energy X-ray photons.

SUMMARY OF THE INVENTION

The present invention presents one solution to the search for a compact, high energy light source by providing a flash X-ray apparatus which operates at a short pulse duration to produce a relatively high average power. The flash X-ray apparatus of the preferred embodiment of the present invention has operated at an average pulse duration less than 6 nsec. at energies near 8.0 keV to produce an average power of 35 mW. In particular, the flash X-ray apparatus hereof can produce in less than 1 minute an integrated X-ray fluence comparable to that obtained from much larger, synchrotrons and laser plasma devices. In applications where the average power delivered and the size of the X-ray source are prime considerations, the compact, flash X-ray apparatus of the present invention offers an attractive alternative to either synchrotron or laser plasma X-ray devices.

Broadly speaking, the apparatus of the present invention includes a commutation means coupled to a power source, a Blumlein operably connected to the commutation means and an X-ray head. The commutation means is coupled to the power source for commuting the current at a high repetition rate and preferably, comprises a hydrogen thyratron in a grounded grid configuration. The Blumlein provides a low impedance switching waveform from the commutation means to the X-ray head. The X-ray head includes a sealable chamber having an X-ray emitting aperture, a pair of spaced apart electrodes mounted in the chamber, and a pair of low impedance connectors which couple the electrodes to the Blumlein. Operationally, application of the commutated current through the low impedance Blumlein and connectors effects a pulsed, flash discharge between the electrodes, causing an X-ray emission through the aperture.

Preferably, the X-ray head includes a base of insulating material, an electrode assembly mounted on the base, a pair of foil sheet conductors passed through the base and connected to the electrode assembly, and a sealable chamber surrounding the electrode assembly. The electrode assembly comprises an anode and cathode, each having an elongated discharge surface, with the discharge surfaces being spaced apart equidistant to define a discharge gap therebetween. The foil conductors are preferably cast integral in the insulating base to provide a low inductance, short path connection between the electrodes and the Blumlein without the possibility of arcing between connectors.

The present invention additionally contemplates a method of generating a flash X-ray fluence at a high repetition rate. Broadly speaking, the method includes supplying a direct current to a thyratron which is operably connected to a low impedance Blumlein. A middle conductor of the Blumlein is charged and the current then commuted over the Blumlein in charge/commuted cycle recurring at a high repetition rate. The high repetition rate power output is transmitted over the Blumlein to a pair of spaced apart electrodes disposed in an evacuated shell. The pulsed current generates a filamentary source of X-ray radiation in the space between the two electrodes to produce a high energy X-ray emission.

DESCRIPTION OF THE PREFERRED EMBODIMENT

Figure 1:
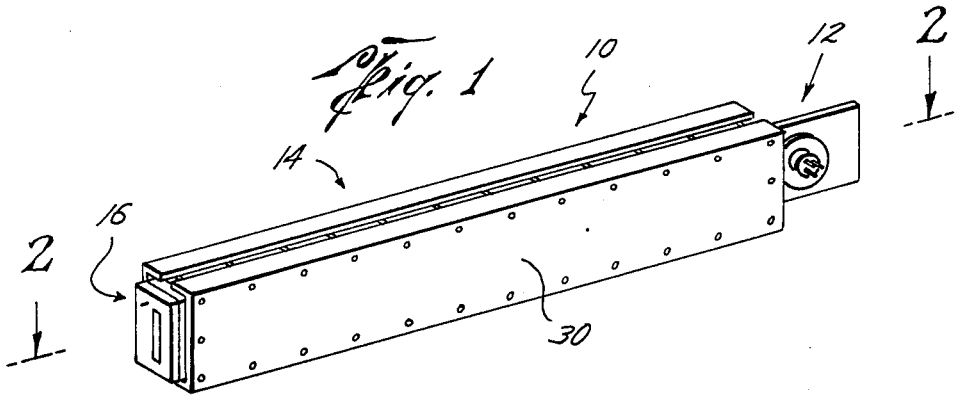
FIG. 1 is a perspective view of the flash X-ray producing apparatus of the present invention.

Turning now to the drawings, an apparatus 10 in accordance with the present invention is illustrated which produces an intense, filamentary source of flash X-rays at a high repetition rate. Broadly speaking, the apparatus 10 includes commutation means 12, Blumlein assembly 14, and an X-ray head 16 (see FIG. 2). Preferably, the commutation means comprises a thyratron can 20 and a thyratron 22 which is capable of operation at a high repetition rate, i.e. greater than 50 Hz. The thyratron 22 is coupled to a power source (not shown), preferably a DC power source.

Figure 5:
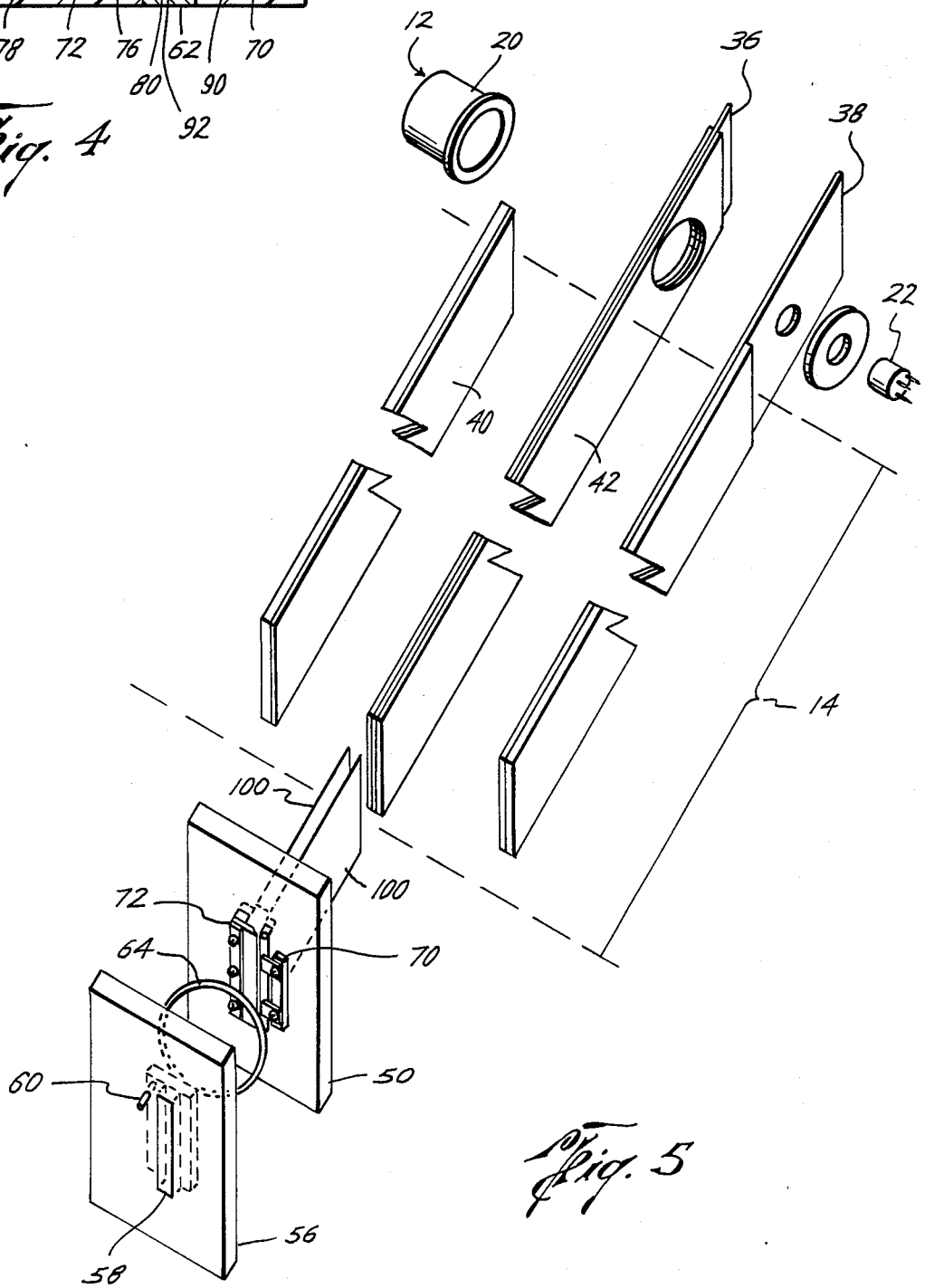
FIG. 5 is a fragmentary, exploded view of the apparatus of the present invention.

The Blumlein assembly 14 includes an outer casing 30 holding the elongated Blumlein device 32 and insulating material 34. As shown in FIG. 5, the Blumlein device 32 broadly includes a middle conductor 36 and a pair of outer conductors presenting switched side 38 and storage side 40. The middle conductor 36 is sandwiched between dielectric sheaths 42 (preferably a polyimide such as Kapton), while the outer conductors 38, 40 are cast in an insulating epoxy material as at 44. In FIG. 5, the thyratron 22 is illustrated somewhat schematically and is coupled to the middle conductor 36 and switched conductor 38 in a grounded grid configuration.

Figure 2:
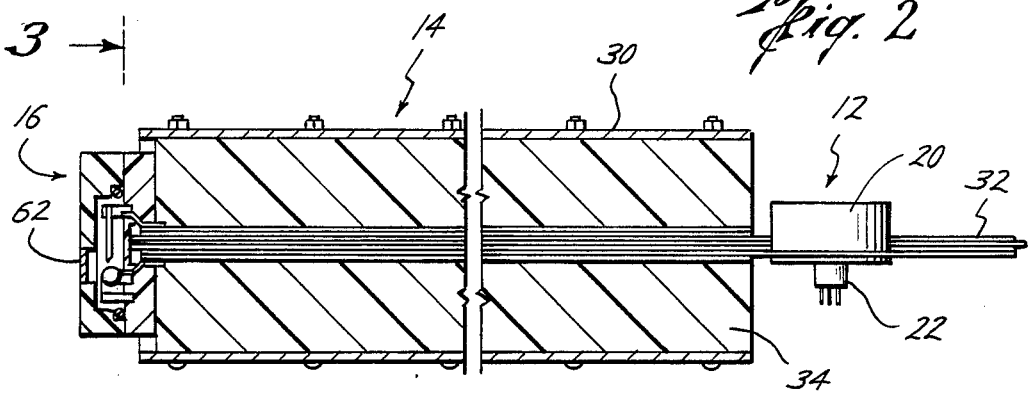
FIG. 2 is a sectional view taken along line 2—2 of FIG. 1 of the apparatus.
Figure 3:
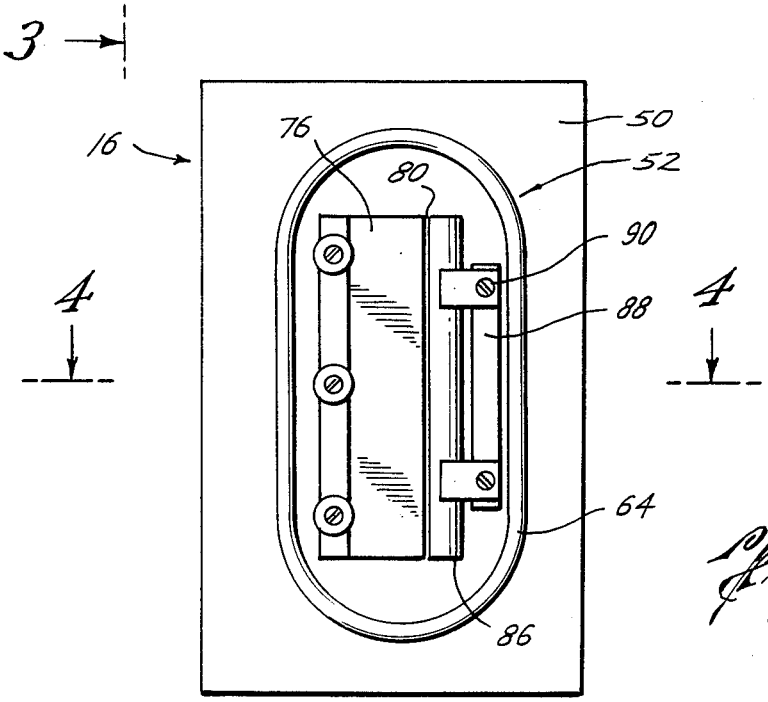
FIG. 3 is a sectional view taken along line 3—3 of FIG. 2 and particularly illustrates the electrode assembly of the X-ray head of the present invention.
Figure 4:
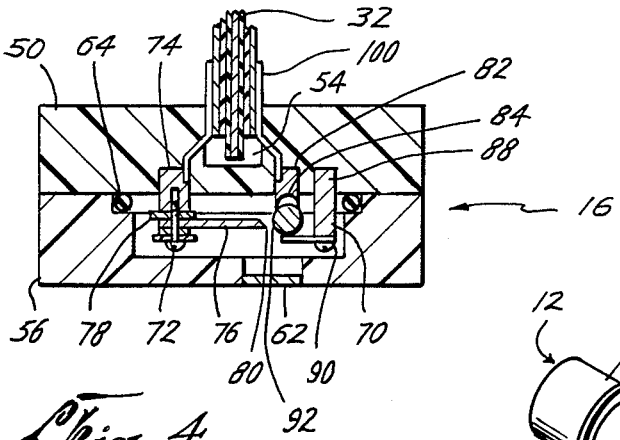
FIG. 4 is a sectional view taken along line 4—4 and illustrates another view of the X-ray head and its connection to the Blumlein.

The X-ray head 16 broadly includes a base plate 50 comprising an insulating material and an electrode assembly 52 mounted on the base 50 as shown in FIG. 3. The base plate 50 is cast to include a Blumlein receiving channel 54 as shown in FIGS. 2 and 4. A cover plate 56 of insulating material is designed to overly base plate 50 (see FIG. 5) and includes an X-ray emitting aperture 58 and evacuation port 60 as shown best in FIGS. 2 and 4. The X-ray emitting aperture 58 includes a polyimide (Kapton) film 62 which operates to permit the emission of X-rays while providing an effective gas seal. An 0-ring 64 is interposed between the base and cover plates 50, 56 around the electrode assembly 52 to cooperatively define a sealed chamber surrounding the electrode assembly 52. It will thus be appreciated that with a mechanical pump (not shown) connected to the evacuation port 60, the 0-ring 64 and film 62 allows the region surrounding the electrode assembly 52 to be partially evacuated (to approximately 3.0 mTorr). The evacuation tends to hold the plate 56 in position relative to the plate 50 but a clamp (not shown) is typically used for added assurance.

In more detail, the electrode assembly includes anode side 70 and a cathode side 72. The cathode side 72 includes a mounting bracket 74 cast integral into the base 50 for supporting the elongated cathode plate 76 (FIG. 4). The cathode plate 76 is coupled to the bracket 74 with one or more screws and shims 78 so that the position of the cathode plate 76 can be adjusted relative to the bracket 74. Preferably, the cathode plate is comprised of graphite and includes a beveled edge at its distal end to define an elongated, thin, discharge surface 80.

The anode side 70 includes a mounting bracket 82 which includes an elongated arcuate channel 84 (FIG. 4) which is cast integral in the base 50. An anode cylinder 86 is received in the channel 84 and positioned in general alignment with the cathode plate 76 as shown in FIGS. 2–4. A retention bracket 88 is cast into the base plate 50 parallel to the mounting bracket 82 and includes a pair of retention clips 90 for retaining the anode cylinder 86 in the mounting bracket 82. Advantageously, the anode cylinder 86 can be rotated in the channel 84 to account for surface wear. Further, the anode cylinder 86 is easily replaceable to change from the copper cylinder of the test embodiment to another cylinder such as tungsten, molybdenum, silicon or platinum.

As can be appreciated from FIGS. 2–4, the anode cylinder 86 comprises an outermost discharge surface 92 which makes contact along the two upper ends of the channel 84 as shown in FIG. 4. The anode cylinder 86 is optimally mounted in general alignment with the cathode plate 76 with the cathode discharge surface 80 oriented generally at the center of the anode cylinder 86. A discharge gap is defined between the cathode discharge surface 80 and anode surface discharge surface 92.

The electrode assembly 52 is coupled to the Blumlein assembly 14 by a pair of copper, foil sheet conductors 100. The foil sheets 100 are cast integral in the base 50 to prevent any air leakage through the base 50 and also to prevent any inadvertent discharge between the foil sheet conductors 100 while providing a low impedance discharge path. As shown in FIG. 4, the foil sheets 100 emerge from the base plate 50 in the region of the channel 54 to connect to the respective outer conductors 38, 40 of the Blumlein device 32. Advantageously, the foil sheets 100 are very thin such that there is practically no coefficient of expansion difficulties between the material of the base 50 and copper foils 100. That is, the thin foils 100 tend to compress somewhat upon differential thermal expansion during operation of apparatus 10.

In its design, the apparatus 10 of the present invention was configured to give a low impedance power transmission through the Blumlein assembly 14 to a low impedance X-ray head 16. The Blumlein conductors 36, 38, 40 were constructed from massive cooper plates and potted with the epoxy casting 44 to reduce corona and separated by the polyimide (Kapton) dielectric sheaths 42. Of course, other dielectrics such as water might conceivably be used. The emphasis of the design was to obtain a singularly low inductance input to the electrode assembly 52 to give a filamentary source of X-ray radiation from the X-ray head 16.

The design of the X-ray head 16 is from cast materials to minimize corrosion, maximize heat transfer, and to prevent inadvertent air leaks around the electrode assembly 52. The design of the foil sheets 100 prevents any transverse constriction of the current path between the Blumlein device 32 and the electrode assembly 52. Further, the effective electrical length of the foil sheets 100 is selected to give a resistance that was comparable to, but below the line impedance of the Blumlein device 32, in order to assist in dampening any secondary ringing of the discharge current between the anode and cathode surfaces 80, 92.

The commutation means 12 in the preferred embodiment was an E.G&G 3202 hydrogen thyratron mounted in a grounded grid configuration. A low voltage power source is connected to heat the thyratron 22, and a high voltage direct current power source was connected to the thyratron 22 with an average available input power to support an operation of the thyratron 22 at a 100 Hertz repetition rate. It will be appreciated that a pulse charge power supply or a resonant pulsed charging device may also be used as a substitute power supply. The thyratron 22 is connected to the middle conductor 36 of the Blumlein device 32 to precharge the Blumlein to a positively high voltage and then fired to commutate the input power.

In the preferred embodiment, the anode cylinder 86 was formed of a copper material for experimental safety. Depending on the application, other suitable conducting metals are desirable substitutes, such as tungsten, depleted uranium, silicon, molybdenum, platinum, rhodium, rhenium or other metal discharge surfaces having the desired spectral characteristics.

With the middle conductor 36 of the Blumlein precharged, the Blumlein 32 is commutated to provide a low inductance pulse through the foil sheets 100 to the electrode assembly 52. The charge voltage of the Blumlein in turn effect a discharge across the gap between the anode and cathode discharge surfaces 80, 92 to produce a filamentary source of X-ray radiation of repetitively pulsed X-ray radiation between the electrodes. As explained in the following illustrative example, the pulsed discharge X-ray effluent has been found to produce a high average power and a short temporal pulse duration with the X-ray pulse energies increasing at higher repetition rates. This increase in X-ray pulse energies at higher repetition rates is in contrast with known applications of Blumleins in gaseous laser media.

EXAMPLE

An apparatus in accordance with the present invention has been constructed and included an EG&G 3202 hydrogen thyratron 22 mounted in a grounded grid configuration to a Blumlein 32. The thyratron 22 was connected to a DC input power source, precharged the middle conductor 36 to 25 KV, and operated at 100 Hertz repetition rate. The approximate line impedance of the Blumlein was calculated about 1.5 ohms with a transit time of approximately 5.3 nsec. The capacitance of the switched side was calculated at 3.5 nF while the storage side 40 was measured at approximately 3.2 nF. While a DC power supply was used in this example, a resonant discharge pulse power input may be used as well.

The cathode graphite plate 76 was 0.381 mm thick with the plate approximately 10 cm in length. In the preferred embodiment, the cathode discharge surface 80 was an elongated rectilinear surface parallel and equidistant from the anode discharge surface 92 of the anode cylinder 86. The distance separating the discharge surfaces 80, 92 was varied to optimize performance.

A mechanical pump was used to evacuate the region surrounding the electrode assembly 52 through the evacuation port 60. In addition to the 0.076 mm thick Kapton plastic film 62, the experimental device included a 0.127 mm thick graphite plate overlying the aperture 58 to prevent the emission of visible and UV light. The mechanical pump was effective and operated to partially evacuate the region at pressures surrounding the electrode assembly 52 below 3.0 mTorr. The evacuation of the region surrounding the electrode assembly 52 held the plates 50, 56 together with a clamp (not shown) added to ensure the arrangement.

Outputs were detected from the X-ray head 16 with a block of fast scintillator plastic detector with a nominal 7.0 nsec. decay time. Measurements of absolute intensities were made by comparing the fluorescence from the plastic detector when illuminated with geometrically attenuated X-rays from the apparatus 10, with the level of excitation produced by a radioactive source of known characteristics. The results obtained suggest that there is a weak dependence of the X-ray effluent output on the spacing between the anode and cathode discharge surfaces 80, 92 over a wide range. Further, the pulse duration was found to have a temporal width of approximately 6 nsec. which can be varied by changing the separation distances between the cathode and anode discharge surfaces 80, 92.

Figure 7:
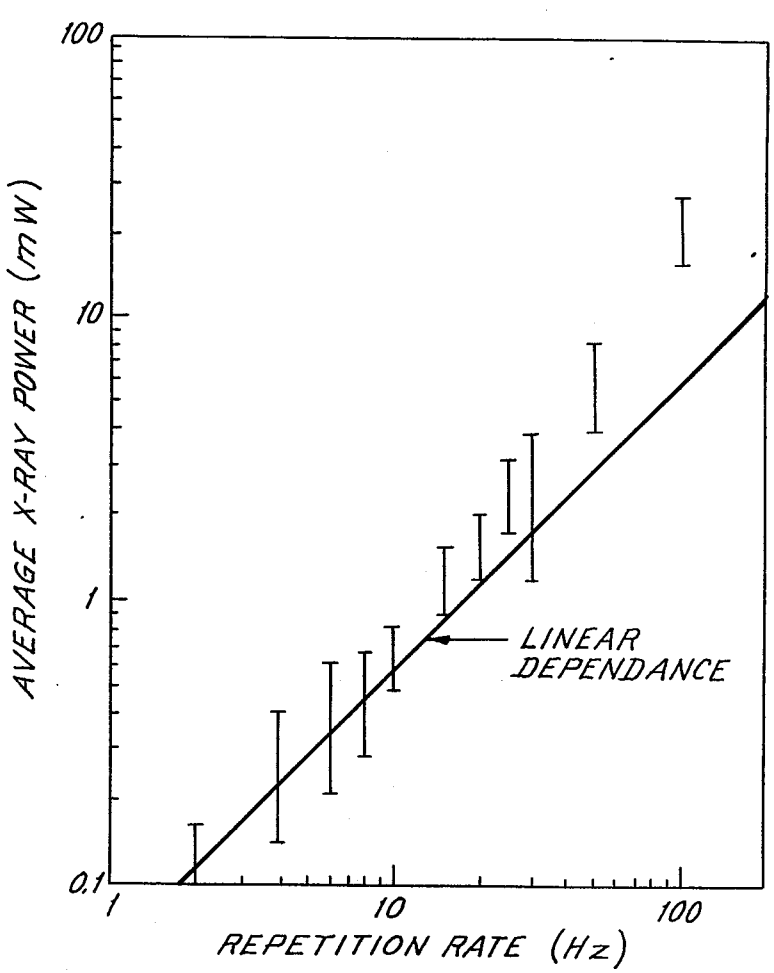
FIG. 7 is a graph which plots average output energies as a function of repetition rate.
Figure 6:
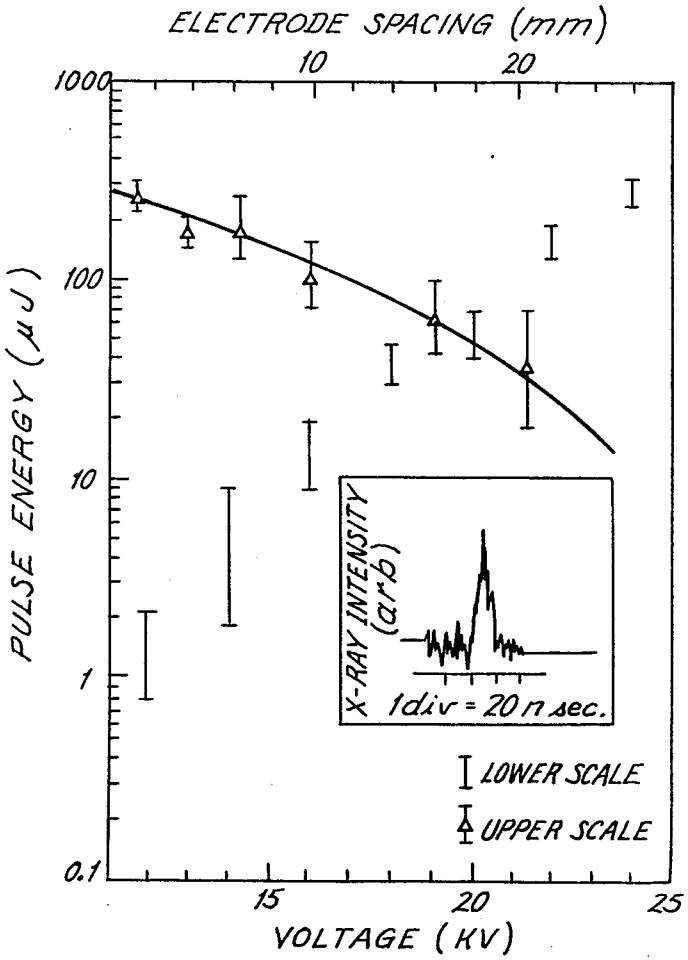
FIG. 6 is a graph which plots the output energies as a function of electrode spacing.

Advantageously, at higher repetition rates, the X-ray pulse energies were found to increase markedly In fact, the average X-ray power emitted as a function of repetition rate was greater than linear, because of the enhancement of the pulse energies at higher values. The apparatus 10 produced 35 mW of average power isotropically from the 6 nsec. pulses at energies near 8 keV. FIGS. 6 and 7 illustrate the experimental results.

What is claimed is:

1. An apparatus for producing flash X-rays, comprising:

a power source;

commutation means coupled to the power source for commuting the current at a high repetition rate;

Blumlein means connected to the commutation means for providing a low impedance switching waveform; and an X-ray head having a gas sealable chamber having an X-ray emitting aperture, a pair of spaced-apart electrodes mounted in the chamber and having an impedance approximating the impedance of the Blumlein means, and a pair of connectors coupled respectively to said electrodes and to the Blumlein means and having an impedance approximating the impedance of the Blumlein means, application of commutated current to the Blumlein means effecting a discharge between the electrodes and an X-ray emission through the aperture, the coupling of the Blumlein means, connectors, and electrodes providing a generally matched, low impedance path to said commutated current.

2. An apparatus in accordance with claim 1, the commutation means comprising a thyratron.

3. The apparatus in accordance with claim 1, the Blumlein comprising three elongated parallel, juxtaposed, plate conductors separated by insulation.

4. The apparatus in accordance with claim 1, the chamber including a base of insulating material, the electrodes comprising an anode and cathode mounted on the base.

5. The apparatus in accordance with claim 4, each connector comprising a foil sheet conductor with a portion of each foil sheet cast integrally in the base.

6. The apparatus in accordance with claim 4, the cathode comprising a bracket cast integral in the base and a graphite plate coupled to the bracket and having an elongated, rectilinear discharge edge.

7. The apparatus in accordance with claim 4, the anode comprising an elongated socket cast integral in the base and an elongated cylinder operatively received in the socket.

8. The apparatus in accordance with claim 7, the socket having a pair of upstanding, elongated parallel horns spaced-apart a distance less than the diameter of the anode cylinder for contacting the cylinder along the length of each horn.

9. The apparatus in accordance with claim 7, the anode cylinder comprising a conducting metal.

10. The apparatus in accordance with claim 9, the anode cylinder comprising copper or tungsten or depleted uranium or silicon or molybdenum or platinum.

11. The apparatus in accordance with claim 1, the power source comprising a direct current source.

12. The apparatus in accordance with claim 1, the power source comprising a pulse charging power supply to the Blumlein.

13. An apparatus according to claim 1, wherein the electrical connectors comprise foil sheets having an impedance below the line impedance of the Blumlein means.

14. An apparatus according to claim 1, wherein said low impedance path to said commutated current has an impedance less than about 30 ohms.

15. An apparatus according to claim 1, wherein said low impedance switching waveform of said Blumlein has an impedance less than about 30 ohms.

16. The apparatus according to claim 15, said Blumlein impedance being less than about 2 ohms.

17. An X-ray head comprising:

a base of insulating material; electrode assembly mounted on the base and having an anode having an elongated discharge surface, a cathode having an elongated discharge surface, the anode and cathode discharge surfaces being spaced apart generally equidistant to define a discharge gap therebetween and being dimensioned and oriented so that each electrode has a similar impedance;

a pair of foil conductors cast integral in the base and respectively connected to the anode and cathode, the impedance of the foil conductors approximating the impedance of the electrodes; and means defining a sealable chamber around the electrode assembly, including an aperture for emitting X-ray fluence from the discharge gap.

18. An X-ray head according to claim 17, the base comprising a first generally flat plate and the chamber defining means including a second generally flat plate overlying the first plate and an O-ring seal interposed between the plates in circumscribing relation to the electrode assembly.

19. An X-ray head according to claim 18, one of the plates including a port in communication with the inner region of the O-ring which is coupleable to a pump for evacuation of the chamber.

20. An X-ray head according to claim 18, the aperture including an opening in the second plate and an X-ray transparent covering over the opening.

21. An X-ray head according to claim 20, the covering comprising a polyimide film.

22. An X-ray head according to claim 20, the covering comprising a graphite overlay.

23. An X-ray head according to claim 17, the elongated discharge surfaces being generally rectilinear and parallel to each other, the foil conductors each comprising a foil sheet of a width generally the same as the length of the corresponding discharge surface.

24. An X-ray head according to claim 17, the base comprising a generally flat plate with the electrode assembly mounted on one side of the plate, the base including structure defining a slot, the foil conductors each presenting a sheet-like configuration cast integral in the base with a portion of each foil sheet disposed in the slot in parallel spaced relation to the other foil sheet.

25. An X-ray head according to claim 17, at least a portion of the electrode assembly being cast in the base.

26. An X-ray head according to claim 17, the anode comprising a socket cast integral in the base and having a U-shaped channel, and the anode discharge surface being cylindrically shaped for operable reception in the channel.

27. An X-ray head according to claim 26, the diameter of the channel being less than the diameter of the anode cylindrical discharge surface for rotatably receiving the cylindrical discharge surface in contact with the uppermost parallel edges of the channel.

28. An X-ray head according to claim 26, including clip means for retaining the anode discharge surface in the channel.

29. An X-ray head according to claim 17, the anode discharge surface comprising copper or tungsten or depleted uranium or silicon or molybdenum or platinum or rhenium or rhodium.

30. An X-ray head according to claim 17, the cathode comprising a mounting bracket cast integral in the base and a plate-like graphite discharge surface operably coupled to the bracket.

31. An X-ray head according to claim 30, the plate-like discharge surface having a beveled cross-section to present a rectilinear, thin edge parallel to the anode discharge surface.

32. A method of generating a flash x-ray source at a high repetition rate comprising the steps of:

supplying a charging current to a thyratron connected to a low line impedance Blumlein;

charging the middle conductor of the Blumlein to a positive voltage;

commutating the input power to the Blumlein at a high repetition rate;

supplying the high repetition rate power output from the low impedance Blumlein through a pair of electrical connectors to a pair of spaced-apart, electrodes disposed in an evacuated shell, the connectors and electrodes having an impedance approximating the low impedance of the Blumlein and generating a filamentary source of x-ray radiation in the space between the two electrodes.

33. The method according to claim 32, wherein the Blumlein low line impedance is less than about 30 ohms.

34. The method according to claim 33, wherein the Blumlein low line impedance is less than about 2 ohms.

35. An X-ray head comprising:

a base of insulating material;

an electrode assembly mounted on the base and having an anode having an elongated discharge surface, the anode comprising a socket cast integral in the base and having a U-shaped channel, and the anode discharge surface being cylindrically shaped for operable reception in the channel, a cathode having an elongated discharge surface, the anode and cathode discharge surfaces being spaced apart generally equidistant to define a discharge gap therebetween;

a pair of foil conductors cast integral in the base and respectively connected to the anode and cathode; and means defining a sealable chamber around the electrode assembly, including an aperture for emitting X-ray fluence from the discharge gap.

* * * * *

UNITED STATES PATENT AND TRADEMARK OFFICE
CERTIFICATE OF CORRECTION

PATENT NO. : 4,947,415

DATED : August 7, 1990

INVENTOR(S) : Collins

It is certified that error appears in the above-identified patent and that said Letters Patent is hereby corrected as shown below:

In claim 1, line 28, column 6, add two hyphens after the word having.

In claim 17, line 30, column 7, add two hyphens after the word having.

Signed and Sealed this

Third Day of September, 1991

*Attest:*

HARRY F. MANBECK, JR.

*Attesting Officer*

*Commissioner of Patents and Trademarks*